United States Patent [19]

Woodford

[11] 4,353,145

[45] Oct. 12, 1982

[54] RUG CLEANING APPARATUS

[76] Inventor: Frank W. Woodford, 452 W. Shore Rd., Warwick, R.I. 02889

[21] Appl. No.: 229,639

[22] Filed: Jan. 29, 1981

[51] Int. Cl.[3] ..... A47L 11/03; A47L 11/202

[52] U.S. Cl. ..... 15/321; 15/320

[58] Field of Search ..... 15/320, 321, 322

[56] References Cited

U.S. PATENT DOCUMENTS

| | | | |
|---|---|---|---|
| 3,840,935 | 10/1974 | Fitzgerald et al. | 15/322 |
| 4,123,818 | 11/1978 | Hurwitz | 15/321 |
| 4,146,944 | 4/1979 | Pinto | 15/321 |
| 4,167,799 | 9/1979 | Webb | 15/322 X |

*Primary Examiner*—Chris K. Moore

*Attorney, Agent, or Firm*—Salter & Michaelson

[57] ABSTRACT

A combination apparatus for the simultaneous shampooing and steam cleaning of a rug, carpet or the like including a main cleaner which is supplied with hot sudsing cleaning solution from a remote reservoir that is simultaneously dispensable directly on to a carpet or the like beneath the cleaner for deep cleaning of the pile thereof and on to rotatable scrubber pads disposed on the bottom of the cleaner. The pads rotatingly engage the carpet or rug to agitate the pile thereof to further effect the cleaning operation and a vacuum apparatus included in the cleaner extracts the spent cleaning solution and dirt or other foreign matter from the carpet or rug by means of a vacuum funnel extractor which extends transversely across the front of the cleaner.

1 Claim, 3 Drawing Figures

RUG CLEANING APPARATUS

BACKGROUND OF THE INVENTION

The instant invention relates to the cleaning of rugs, carpets and the like and more particularly to a portable combination apparatus which effects both shampooing and steam cleaning of rugs and carpets. Heretofore separate devices have been available to clean rugs or carpets by either shampooing or steam cleaning. With conventional shampooers, a foaming detergent is applied to the rug or carpet, and the rug or carpet is mechanically scrubbed to effect the cleansing thereof. Thereafter the rug or carpet is vacuumed with a wet vacuum cleaner to accelerate drying time; and after the rug or carpet is completely dry, it is again vacuumed to remove any dirt particles left behind by the detergent. Unfortunately, however, while rug shampooing is an effective method of removing surface dirt from a rug, it has often proven to be somewhat less than satisfactory for removing dirt or foreign matter embedded in the pile of a rug or carpet. Previously known devices of this type representing the closest prior art of which applicant is aware are shown in the following U.S. Pats.: Hughes et al. No. 3,686,707; Hughes No. 3, 797,065.

On the other hand, steam cleaning is an effective method for removing dirt deeply embedded in the pile of a carpet, although it may not be entirely effective for removing all of the surface dirt. Traditional steam cleaning operations have involved the use of apparatus for spraying substantial amounts of non-foaming hot water-detergent solution (steam cleaning being somewhat of a misnomer) onto a rug or carpet. Unfortunately, with this method, substantial amounts of cleaning solution are required to penetrate deeply into the pile of the carpet or rug and as a result, the rug or carpet becomes fully saturated with solution. The carpet or rug may be thereafter vacuumed with a suitable wet vacuum cleaner to extract as much of the solution as possible therefrom to accelerate the drying time, but extended periods of time are still often required to effect complete drying. Obviously, substantial amounts of dirt and other foreign matter will be extracted by this method, but since conventional rug steam cleaners do not employ mechanical scrubbing apparatus, they also are somewhat less than fully effective rug cleaning devices. In the past, commercial rug cleaning operations have frequently involved both the shampooing and the steam cleaning of rugs. For cleaning heavily soiled rugs, commercial rug cleaners have often first shampooed the rug or carpet as above-described to remove surface dirt therefrom and thereafter steam cleaned it, also as above-described, to remove deeply embedded dirt therefrom. Unfortunately, to carry out this procedure, a substantial amount of time is required as it involves two separate complete operations and two separate pieces of equipment. The apparatus of the instant invention combines the steam cleaning operation with the shampooing operation to provide a device for effectively cleaning a rug or carpet in a single operation and therefore results in considerable savings of both time and expense. Furthermore, by combining the steam cleaning function and the shampooing function in one apparatus, effective rug cleaning operations may be carried out with significantly smaller amounts of cleaning solution to result in even further cost savings.

SUMMARY OF THE INVENTION

The instant invention relates to the cleaning of rugs and the like and more particularly the instant invention relates to a combination device for simultaneously steam cleaning and shampooing a rug or carpet. The device of the instant invention comprises a main housing with one or more mechanically operated scrubber pads attached thereto, the pads being engageable with a rug or carpet positioned therebelow for the scrubbing thereof. A remote reservoir supplies pressurized hot sudsing detergent solution to the apparatus where it is simultaneously dispensable onto the scrubber pads through a dispensing nozzle and directly onto a carpet or rug through a spray nozzle located behind the pads. A vacuum extractor nozzle is provided in the front of the apparatus for vacuuming the spent detergent from the rug or carpet after it has been cleaned. In operation, the apparatus is advanced by an operator in a rearward direction with the spray nozzle spraying the cleaning solution into the rug or carpet. The scrubbing pads thereafter scrub the carpet or rug with additional cleaning solution which has been introduced to the pads. The vacuum extractor then removes the spent detergent from the carpet to complete the cleaning operation.

Particular note should be taken of the fact that the apparatus of the instant invention carries out a steam cleaning function using a sudsing detergent. Traditionally steam cleaning apparatuses have required the use of substantial amounts of detergent which are later vacuumed from the rug or carpet. Consequently, the use of sudsing detergents have always been impractical for conventional steam cleaning apparatuses since the foaming characteristics of sudsing detergents tend to further increase the volume of detergent to be vacuumed from the carpet. Since the apparatus of the instant invention employs scrubber pads which agitate the detergent after it has been applied to the carpet, it functions effectively with substantially smaller quantities of cleaning solution. As a result, the use of sudsing detergents which are generally regarded as the most effective detergents available, are for the first time made practical for steam cleaning.

It will be seen therefore that the apparatus of the instant invention is a substantial improvement over previously known rug cleaning devices. By combining the shampooing function with the steam cleaning function, the apparatus of the instant invention provides a device which can be used to effectively clean a rug or carpet in substantially less time resulting in substantial cost savings. Furthermore, as a result of the reduction in the amounts of cleaning solution required, additional savings will be realized and the rugs or carpets cleaned with this apparatus will dry much more quickly.

Accordingly, it is an object of the instant invention to provide an apparatus which can be used to simultaneously steam clean and shampoo a carpet or rug.

Another object of the instant invention is to provide an apparatus for commercial rug cleaning operations which will effectively clean a rug or carpet in a minimum of time.

A still further object of the instant invention is to provide a device for effectively cleaning a rug or carpet by shampooing and steam cleaning using a sudsing detergent.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
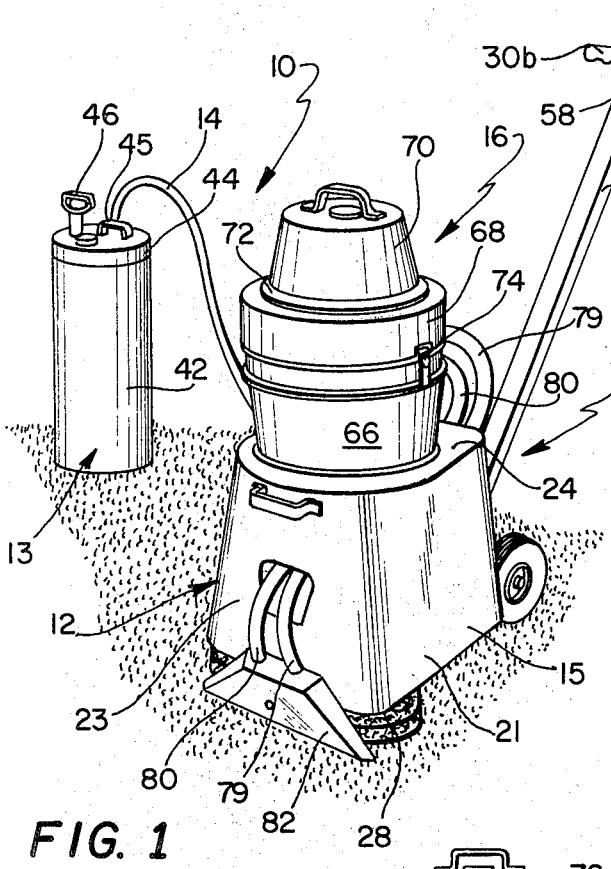
FIG. 1 is a perspective view of the apparatus of the instant invention.

Referring now to the drawing, the rug cleaning apparatus of the instant invention is shown in FIG. 1 generally indicated at 10. As will be noted, the rug cleaning apparatus 10 comprises a main cleaner generally indicated at 12 and a reservoir generally indicated at 13 which supplies hot pressurized cleaning solution to the cleaner 12 through a flexible hose 14.

Figure 3:
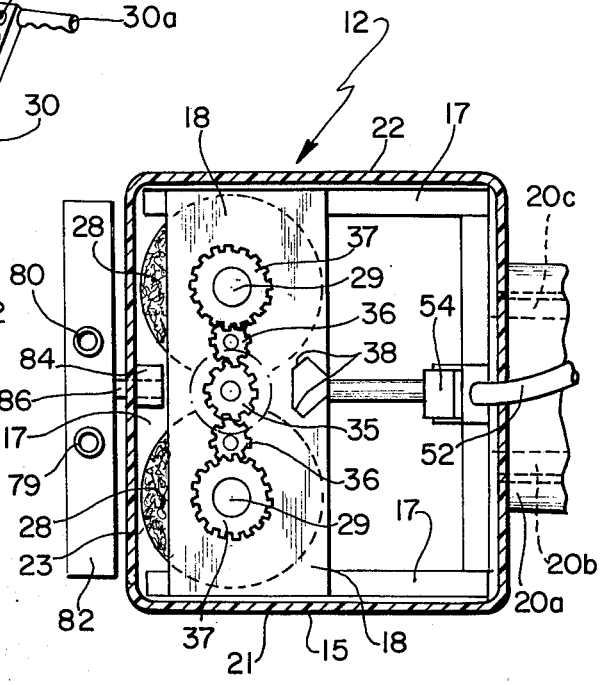
FIG. 3 is a top plan sectional view of the apparatus of the instant invention taken along line 3—3 of FIG. 2.
Figure 2:
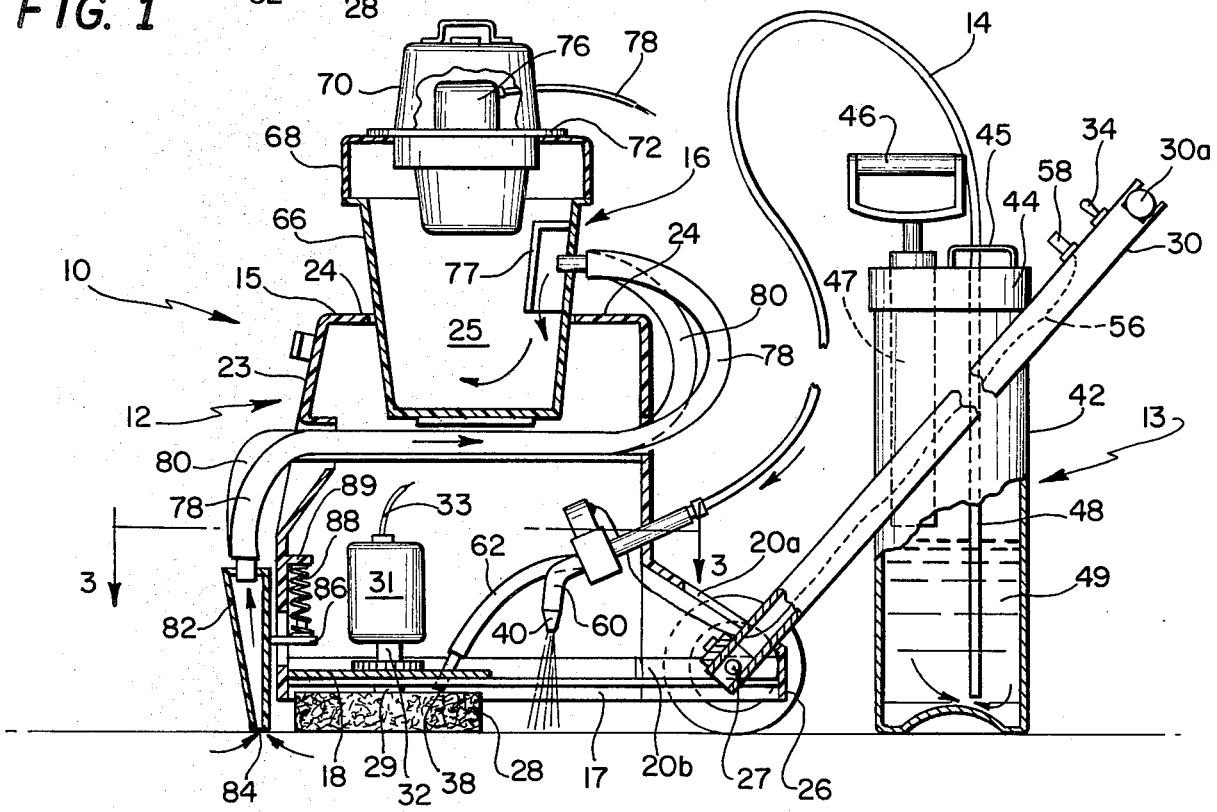
FIG. 2 is an elevational side sectional view of the apparatus with the cleaning solution tank shown partially in section.

The main cleaner 12, as will be further noted from FIGS. 2 and 3, has a lower main housing 15 with a vacuum apparatus generally indicated at 16 mounted thereon. A bottom frame 17 is attached to the lower inner periphery of the housing 15, the frame 17 being constructed of rigid L-shape angle members which are connected together to provide a substantially rectangular frame. A substantially flat base 18 is generally rectangular configuration is provided extending across the front portion of the frame 17, being attached thereto in substantially horizontal disposition. Preferably, the frame 17 and the base 18 will be made of steel or other rigid material which will be coated with a corrosion resistant substance to prevent excessive corrosion from prolonged exposure to detergent solutions during the rug cleaning operations. The main housing 15 has generally the configuration shown with a rear wall 20, a pair of substantially flat vertical side walls 21 and 22 and a front wall 23 which is substantially flat at its bottom end and substantially arcuate at its upper end, all upstanding from the frame 17. As will be noted, the top portion of the rear wall 20 is substantially vertical, with an axle housing **20*a* extending outwardly from the central bottom portion of said wall. A pair of axle brackets 20*b* and 20*c* also constructed of L-shaped angle members extend rearwardly from the rear portion of the frame 17 within the axle housing 20*a*. As will be further noted, the main housing 15 has a top wall 24 with a centrally located recess 25 of substantially circular section formed therein for receiving the vacuum apparatus 16. Preferably, the main housing 15 will be constructed of molded fiberglass although it is understood that other suitable construction materials may be used. A pair of wheels 26 provide support for the cleaner 12 at the rear end thereof, being rotatably mounted on the rear ends of the brackets 20*b* and 20*c* as shown with an axle 27 extending therebetween. A pair of circular scrubber pads 28 are provided extending downwardly from the base 18, the pads 28 being journaled for rotation in substantially horizontal disposition therebeneath and providing support for the front end of the cleaner 12. Preferably, the pads 28 will be detachably mounted beneath the base 18 on a pair of shafts 29 which extend upwardly through the base 18 as shown. Preferably, the pads 28** will be made of a matted synthetic scouring material such as Scotch Brite (3M trademark) "super scrubber" scouring material although it is understood that various other suitable materials are available, such as conventional bristle type brushes of sufficient coarseness to be suitable for a rug cleaning operation.

As stated, the cleaner 12 is supported at the rear end thereof by the wheels 26 and at the front end thereof by the pads 28. In order to effect the movement of the cleaner 12 on the wheels 26 and the pads 28 by an operator, an elongated handle 30 with outwardly extending bars **30*a* and 30*b* is attached to the axle 27 between the wheels 26 extending upwardly and rearwardly therefrom. Preferably the handle 30 will be hingeable to an upright position for storage and will be dimensioned to facilitate operation of the cleaner 12 by an operator standing or walking therebehind. Further the preferred mounting of the handle 30 on the cleaner 12 will include means for limiting the downward angular movement of the handle relative to the cleaner 12 so that the entire cleaner 12 may be tilted rearwardly so as to rest entirely on the wheels 26 for simple movement of the cleaner 12 when not in operation. A drive motor 31 with a vertically disposed drive shaft 32 is mounted on the base 18 within the main housing 15 to effect the rotation of the pads 28. The motor 31 is energizable with standard household current through a wire 33, activation of the motor 31 being effected with a switch 34 located near the upper end of the handle 30. As hereinbefore stated, the pads 28 are rotatably mounted on the bottom of the base 18 by means of the shafts 29 attached to the pads 28 and extending upwardly through the base 18. As will be noted particularly from FIG. 3, a pinion gear 35 is provided on the drive shaft 32 in communication with a pair of idler gears 36, also mounted on the base 18, which drive a pair of drive gears 37 mounted on the shafts 29. Accordingly, when the drive motor 31 is energized, the pinion gear 35 is rotated, rotating the idler gears 36 and the drive gears 37 to cause rotation of the pads 28**.

In order to effect the rug shampooing function of the apparatus 10, a pair of dispensing nozzles 38 are mounted on the bottom at the base 18 and directed downwardly therefrom. As will be noted, the dispensing nozzles 38 are oriented to dispense cleaning solution directly onto the tops of the pads 28. In this manner, the cleaning solution is evenly distributed on the rug or carpet by permeating through the pads 28 as they are rotated.

The steam cleaning function of the apparatus is effected by means of a spray nozzle 40 located within the housing 15 behind the pads 28 and directed downwardly for dispensing cleaning solution directly onto a rug or carpet positioned therebeneath. By spraying the cleaning solution directly on the rug or carpet, it penetrates deeply into the pile thereof to remove deeply embedded dirt or other foreign matter. Furthermore, since the carpet or rug is also being mechanically scrubbed, the removal of deeply embedded foreign matter and dirt can be effected with substantially lesser amounts of cleaning solution than were required with previously known steam cleaning devices.

As was hereinbefore stated, the reservoir 13 is provided for supplying hot pressurized sudsing cleaning solution to the cleaner 12. The reservoir 13 comprises a metallic tank 42 with a top 44 and a handle 45 with a pressure handle 46 which is attached to a pressure pump 47 within the tank 42. A feed line 48 is attached to the hose 14 at the top 44 extending downwardly into the tank 42 to draw solution therefrom as needed. As hereinbefore stated, the hose 14 extends from the reservoir 13 to the cleaner 12. The hose 14 will preferably be made of a flexible synthetic hose material suitable for carrying the hot pressurized cleaning solution 49 from the reservoir 13 to the cleaner 12. Preferably, the hose 14 will be of sufficient length to permit an operator to freely move the cleaner 12 to clean an area of rug without moving the reservoir 13. It should be noted that while it would be possible to construct the rug cleaning apparatus of the instant invention with the reservoir tank for the cleaning solution being included as an integral part of the cleaner, it is not deemed practical to do so since such a construction would unnecessarily increase the size and weight of the cleaning unit.

The hose 14 is detachably connected to the cleaner 12 by a coupling 50 which communicates with conduit 52 which in turn extends into the main housing 15 and is operatively associated with a solenoid controlled valve 54, as will be noted. A wire, shown at 56, extends from the solenoid valve 54 through the handle 30 to a push button switch 58 externally mounted at the top of the handle 30 for easy actuation by an operator. A pair of conduits 60 and 62 extend from the solenoid valve 54 respectively to the spray nozzle 40 and the dispensing nozzle 38 as shown. Accordingly, the cleaning solution is dispensed as needed with an operator activating the push button switch 58 to activate the solenoid valve 54 to thereby simultaneously dispense cleaning solution through the spray nozzle 40 and the dispensing nozzles 38.

As hereinbefore noted, a vacuum assembly 16 is mounted on the top of the scrubber 12 being received in the recess 25. Preferably, the vacuum assembly 16 will be dimensioned to fit snuggly in the recess 25, being removable therefrom to empty spent cleaning solution from the vacuum assembly 16 as it is accumulated. The vacuum assembly 16, as will be noted, is of substantially circular section, and is defined by a holding tank 66 having a cover 68 with a vacuum pump 70 mounted thereon, the vacuum pump 70 extending through the central portion of the cover 68 and being secured thereto at 72 with an air tight seal therebetween. The cover 68 is attached to the holding tank 66 in substantially air tight engagement with a pair of buckles 74 being provided to effect such attachment. An electric motor 76 which is also activated by the switch 34 located on the handle 30 and which is energizable with conventional household current through a wire 78 is provided in the vacuum pump 70 and accordingly, energization of the motor 76 activates the pump 70 to create a vacuum within the holding tank 66. It is anticipated that substantial amounts of liquid and other foreign matter will be carried into the holding tank 66 and therefore a de-mister shield 77 is provided within the tank 66 to direct the liquid downwardly to improve the efficiency to the unit as a wet vacuum. A pair of flexible hoses 79 and 80 are attached to the rear of the holding tank 66 extending downwardly therefrom and then forwardly through the main housing 15 and again downwardly in front thereof where they are attached to a vacuum funnel extractor 82. As will be noted, the extractor 82 extends transversely across the lower portion of the front of the cleaner 12 and is formed to extract spent cleaning solution and other foreign matter from a rug or carpet with an elongated opening 84 being provided on the bottom end of the extractor 82 for receiving said solution and foreign matter. As will be noted, the funnel 82 is tapered inwardly from the bottom outer ends thereof to direct said solution and foreign matter into the hoses 79 and 80 after the extraction thereof from a carpet or rug. In order to mount the funnel 82 on the cleaner 12, a mounting bracket 86 is provided extending rearwardly therefrom into the interior of the main housing 15 where it is attached to a vertical spring 88. The spring 88 is mounted interiorly on the front wall of the main housing 15 at 89 and accordingly, provides downward biasing for the funnel 82 to effect a slightly pressurized engagement of the bottom end thereof with a carpet or rug positioned therebeneath to improve the efficiency of the funnel 82 in extracting spent cleaning solution or foreign matter therefrom. When the vacuum pump 70 is actuated, it operates to effect a vacuum within the holding tank 66, the hoses 79 and 80 and the funnel 82 and an airstream with spent cleaning solution and foreign particles intermixed therewith is drawn upwardly through the funnel 82, through the hoses 79 and 80 and into the holding tank 66.

In operation, the reservoir 13 is filled with a hot sudsing cleaning solution and is pressurized with the pump 48 to provide a supply of said solution to the cleaner 12. The cleaner 12 is energized with the switch 34 to activate the rotary action of the pads 28 and the vacuum assembly 16. An operator then pulls the cleaner rearwardly along the surface of a rug or carpet, dispensing cleaning solution as desired by operation of switch 58 and solenoid valve 54, the cleaning solution being simultaneously jet sprayed directly onto the rug and onto the cleaning pads 28. In this manner, the rug or carpet is simultaneously steam cleaned and shampooed with the cleaning solution being sprayed through the spraying nozzle 40 penetrating deeply into the rug or carpet and the pads 28 acting to thereafter agitate the rug or carpet to further effect the cleansing thereof. After the carpet or rug is thus cleaned, the vacuum nozzle 82 engages the surface thereof extracting spent cleaning solution and foreign matter therefrom to complete the operation.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for the cleaning of rugs and the like comprising:

a. a main housing;

b. means for movably supporting said housing on a carpeted supporting surface;

c. handle means attached to said housing for effecting movement of said apparatus by an operator;

d. means attached to said housing for scrubbing a carpet when said apparatus is positioned thereupon;

e. means for dispensing cleaning solution to said scrubbing means;

f. means for spraying cleaning solution onto a section of carpet in the proximity of said scrubbing means when said apparatus is positioned on a carpet;

g. means for supplying heated, pressurized cleaning solution to said dispenser means and said spray means; and h. vacuum means attached to said housing for vacuuming a carpet when said apparatus is positioned thereupon;

said vacuum means comprising a vacuum nozzle of elongated section extending transversely across one end of said housing, said scrubbing means being positioned within said housing spaced slightly interiorly of said nozzle, said spraying means being positioned within said housing on the opposite side of said scrubbing means from said nozzle whereby as said apparatus is moved over a carpet, the latter is sequentially spray cleaned, scrubbed and vacuumed.

* * * * *